US009335666B2

(12) United States Patent
Sakamaki

(10) Patent No.: US 9,335,666 B2
(45) Date of Patent: May 10, 2016

(54) DEVELOPING DEVICE AND IMAGE FORMING APPARATUS

(71) Applicant: CANON KABUSHIKI KAISHA, Tokyo (JP)

(72) Inventor: Tomoyuki Sakamaki, Toride (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/638,115

(22) Filed: Mar. 4, 2015

(65) Prior Publication Data

US 2015/0268586 A1 Sep. 24, 2015

(30) Foreign Application Priority Data

Mar. 24, 2014 (JP) ..... 2014-059931

(51) Int. Cl.
*G03G 15/09* (2006.01)

(52) U.S. Cl.
CPC .... *G03G 15/0921* (2013.01); *G03G 2215/0648* (2013.01)

(58) Field of Classification Search
CPC ..... G03G 15/0921; G03G 15/09; G03G 15/0877; G03G 15/0893; G03G 2215/0838; G03G 2215/0609; G03G 15/0812; G03G 15/0928; G03G 2215/0607; G03G 15/0815; G03G 15/0865; G03G 15/0121; G03G 15/0808
See application file for complete search history.

(56) References Cited

U.S. PATENT DOCUMENTS

| | | | | |
|---|---|---|---|---|
| 6,973,281 | B2 | 12/2005 | Hirobe et al. | |
| 6,975,825 | B2 | 12/2005 | Sakamaki et al. | |
| 6,978,108 | B2 | 12/2005 | Sakamaki | |
| 7,010,253 | B2 | 3/2006 | Kakimoto | |
| 7,099,609 | B2 | 8/2006 | Hirobe et al. | |
| 7,561,838 | B2 | 7/2009 | Sakamaki et al. | |
| 7,653,336 | B2 | 1/2010 | Akashi et al. | |
| 7,725,061 | B2 | 5/2010 | Sakamaki et al. | |
| 7,853,186 | B2 | 12/2010 | Akashi et al. | |
| 7,917,069 | B2 | 3/2011 | Sakamaki | |
| 8,355,655 | B2 | 1/2013 | Sakamaki | |
| 2004/0136755 | A1 | 7/2004 | Kakimoto | |
| 2013/0136506 | A1 | 5/2013 | Sakamaki | |
| 2013/0195515 | A1* | 8/2013 | Tanaka et al. | 399/269 |
| 2013/0315635 | A1* | 11/2013 | Funada et al. | 399/269 |
| 2015/0104220 | A1 | 4/2015 | Sakamaki et al. | |

FOREIGN PATENT DOCUMENTS

JP 2004-191469 A 7/2004

* cited by examiner

*Primary Examiner* — Roy Y Yi
(74) *Attorney, Agent, or Firm* — Fitzpatrick, Cella, Harper & Scinto

(57) ABSTRACT

A developing device includes a first magnet fixed inside a first developer bearing member and including a pair of first repulsion magnetic poles with the same polarity and disposed adjacent to each other, and a second magnet fixed inside a second developer bearing member and including a pair of second repulsion magnetic poles with the same polarity and disposed adjacent to each other. The first magnet has a magnetic flux density distribution of a normal component of the first developer bearing member in the circumferential direction of the first developer bearing member having only one minimal point between the pair of first repulsion magnetic poles, and the second magnet has a magnetic flux density distribution of a normal component of the second developer bearing member in the circumferential direction of the second developer bearing member having a plurality of minimal points between the pair of second repulsion magnetic poles.

6 Claims, 10 Drawing Sheets

FIG. 4

$$F = (m \cdot \nabla) B$$

WHERE $F = (Fr, F\theta, Fz)$

MAGNITUDE OF MAGNETIC FORCE $|F| = (Fr^2 + F\theta^2 + Fz^2)^{1/2}$

THE MAGNETIC DIPOLE MOMENT m OF THE MAGNETIC CARRIER IN THE ABOVE FORMULAS GENERALLY HAS MAGNETIZATION WHICH IS PROPORTIONAL TO AN EXTERNAL MAGNETIC FIELD (THE MAGNETIC FLUX DENSITY B) AND IT CAN BE EXPRESSED AS FOLLOWS.

$$m = |A| B$$

$$F = |A| (B \cdot \nabla) B$$

$$= -|A| \nabla B^2$$

$$Fr(r,\theta,z) = -|A| \{ B^2(r,\theta,z) - B^2(r+\Delta r,\theta,z) \} / \Delta x$$

$$F\theta(r,\theta,z) = -|A| (1/r) \{ B^2(r,\theta,z) - B^2(r,\theta+\Delta\theta,z) \} / \Delta\theta$$

$$Fz(r,\theta,z) = -|A| \{ B^2(r,\theta,z) - B^2(r,\theta,z+\Delta z) \} / \Delta z \ (\fallingdotseq 0)$$

WHERE |A| DENOTES A FUNCTION INCLUDING PERMEABILITY AND SO ON AND IT CAN BE EXPRESSED AS FOLLOWS WHEN THE CARRIER IS SPHERICAL.

$$|A| = (4\pi/\mu_0) \times (\mu - 1) / (\mu - 2) \times r^3$$

WHERE r DENOTES THE RADIUS OF THE CARRIER, μ DENOTES THE RELATIVE PERMEABILITY THE CARRIER AND $\mu_0$ DENOTES THE ABSOLUTE PERMEABILITY OF VACUUM.

DEVELOPING DEVICE AND IMAGE FORMING APPARATUS

BACKGROUND OF THE INVENTION

1. Field of the Invention

The present invention relates to a developing apparatus which performs development using an electrophotographic system and which has a plurality of the developer bearing members, and to an image forming apparatus using the developing apparatus.

2. Description of the Related Art

As an image forming apparatus such as an electrophotographic copying machine, a developing device using a magnetic brush method of two-component developing method is known. Also, a method of development in which one developing sleeve (developer bearing member) is used for one photosensitive drum (image bearing member) is generalized.

However, in the recent demand of high-speed to a copying machine, when the speed of the rotational movement of the photosensitive drum becomes faster, a preferable image is not necessarily formed with only one developing sleeve.

Thus, there is a developing device in which a plurality of developing sleeves are disposed to be adjacent to each other such that peripheral surfaces of the developing sleeves are close to each other. With this configuration, it is possible to enhance the capability of development by the prolonged developing time because the developer is conveyed continuously on the peripheral surfaces of the developing sleeves. This system is referred to as a multi-stage magnetic brush development system.

Next, a conventional developing device of a multi-stage magnetic brush development system which includes two developing sleeves will be explained. FIG. 10 is an explanatory view of a developing device of a conventional multi-stage magnetic brush development system.

The developing device 104 includes a developing container 122. The developing container 122 is partitioned into the developing chamber R1 and the stirring chamber R2 by the partition 123.

The conveying screw 124 is disposed in the developing chamber R1 for stirring and conveying the developer. The conveying screw 125 is disposed in the stirring chamber R2 for stirring and conveying the developer in the opposite direction to the conveying screw 124. The developer is circulated and conveyed while being passed at both ends of the developing chamber R1 and the stirring chamber R2.

At the opposing portion of the photosensitive drum 101 in the developing container 122, two developer bearing members of the first developing sleeve 126 and the second developing sleeve 128 are provided. The first magnet roller 127 is fixedly disposed in the first developing sleeve 126 and the second magnet roller 129 is fixedly disposed in the second development sleeve 128. The layer thickness regulating blade 121 is disposed oppositely to the first developing sleeve 126 in the upstream side of the portion facing the photosensitive drum 101 on the first developing sleeve 126.

With this configuration, the layer thickness of the developer supplied from the conveying screw 124 in the developing chamber R1 to the first developing sleeve 126 is regulated by layer thickness regulating blade 121. Then, the developer is used for the first development at the opposing portion between the photosensitive drum 101 and the first developing sleeve 126. Then, the developer is passed to the second developing sleeve 128 and is further used for the second development. The developer used for the second development at the second development sleeve 128 is returned to the stirring chamber R2.

Thus, in the multi-stage magnetic brush development system, it is possible to obtain high development efficiency by performing development twice.

However, at the region where the first magnetic roller 127 and the second magnet roller 129 are opposed in the developing device having two developing sleeves as described above, the magnetic flux density between them becomes high and the developer restraining force by magnetic force increases. Thus, with the interaction of the magnetic force by the two magnet rollers and the driving force of the rotation of the developing sleeves, the space at the developing container side between the first developing sleeve 126 and the second development sleeve 128 is likely to be filled with the developer.

The developer filled in this space is the one which remains after developing is completed. Thus, the developer is in a state where the toner density is lower than the developer immediately after the developer has passed through the layer thickness regulating blade 121. The developer filled in the space is conveyed back to the second developing sleeve 128 by the rotation of the second developing sleeve 128 and effect of the magnetic force of the second magnet roller 129. Then, the developer coating amount of the second developing sleeve 128 becomes much larger than that of the first developing sleeve 126 regulated by the layer thickness regulating blade 121.

As explained above, when the developing process of an electrostatic latent image on the photosensitive drum 101 by the second developing sleeve 128 is performed in the state in which the developer of which toner density is lowered is mixed, the formation of image failure such as density reduction may occur. In addition, when the coating amount of the second developing sleeve 128 is greater than the appropriate value, an overflow of the developer from the developing container 122 occurs and there is a risk of splashing of the developer inside the apparatus.

As a countermeasure of this problem, U.S. Patent Application Publication No. 2004/136755 A1 discloses the provision of the regulating member for regulating the entry of the developer into the space between the first development sleeve 126 and the second development sleeve 128. As shown in FIG. 10, the regulating member 130 is provided in the region between the first developing sleeve 126 and the second developing sleeve 128 for preventing drag motion of the developer. As a result, the developer after completion of the development is prevented from entering the space from the second developing sleeve 128.

However, in FIG. 10, when the regulating member 130 is provided, new problems occur as follows.

The regulating member 130 mechanically blocks out the entering of the developer after development between two developing sleeves. The developer after development is subjected to thrust force by the magnetic force of the magnet roller and the rotation of the developing sleeve. Therefore, for peeling off the developer on the second developing sleeve 128, the mechanical pressure which is larger than the combination of the magnetic force and the thrust force must be applied. Then, the developer near the regulating member 130 can be hardened by the pressure of the regulating member 130 and the developer may aggregate.

Agglomerates fall in the stirring chamber R2 from the vicinity of the regulating member 130 and are conveyed from the stirring chamber R2 to the developing chamber R1 by the conveying screw 125. Thus, the agglomerates of the developer are borne on the first developing sleeve 126 and thereafter are finally caught by the layer thickness regulating blade 121. Thereby, the appropriate coating for the first developing sleeve 126 of the developer is affected and a so-called white stripe-like image may occur.

SUMMARY OF THE INVENTION

The present invention suppresses occurrence of agglomerates and maintains a high image quality in a developing device having a plurality of developer bearing members.

A typical configuration of the present invention is a developing device, comprising:

a first developer bearing member which includes a first magnetic field generating member having a plurality of magnetic poles for bearing and conveying developer including magnetic particles; and a second developer bearing member which includes a second magnetic field generating member having a plurality of magnetic poles for bearing and conveying the developer delivered from the first developer bearing member, wherein the first magnetic field generating member and the second magnetic field generating member respectively have a first low magnetic field region and a second low magnetic field region formed by adjacent magnetic poles having a same polarity among respective plurality of magnetic poles, wherein two or more minimal points are formed in magnetic flux density of a normal component of a surface of the second developer bearing member in the second low magnetic field region, and wherein one minimal point is formed in magnetic flux density of a normal component of a surface of the first developer bearing member in the first low magnetic field region.

Further features of the present invention will become apparent from the following description of exemplary embodiments with reference to the attached drawings.

BRIEF DESCRIPTION OF THE DRAWINGS

FIG. 4 is a diagram summarizing the formulas for describing a magnetic force on the magnetic carrier.

DESCRIPTION OF THE EMBODIMENTS

Embodiment

Figure 1:
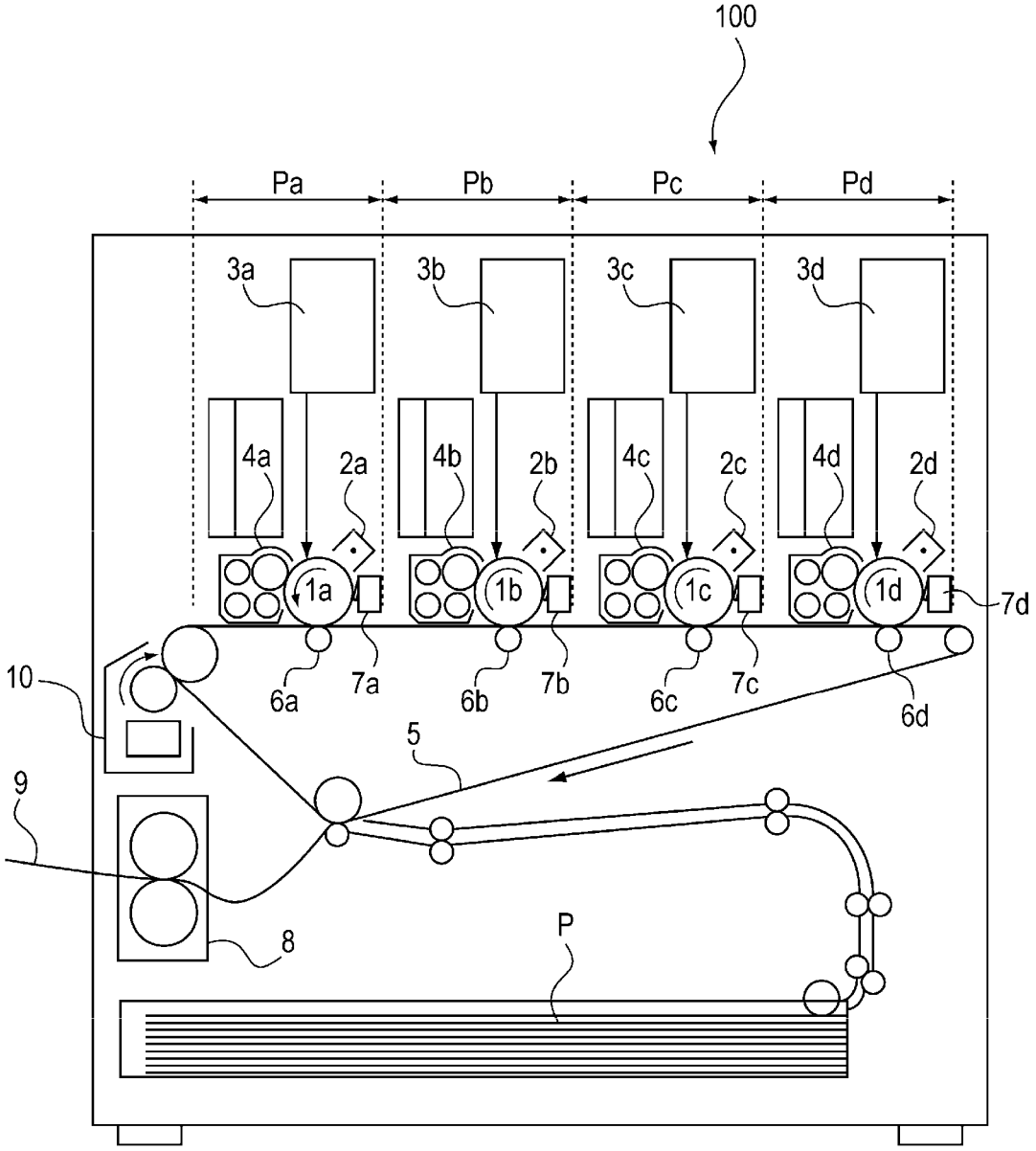
FIG. 1 is an overall explanatory view of an image forming apparatus of an embodiment of the present invention.

An embodiment of the present invention will be explained in detail with reference to the figures. FIG. 1 is an overall explanatory view of an image forming apparatus of this embodiment.

(Image forming apparatus) As shown in FIG. 1, the image forming apparatus 100 is a full color printer of the tandem type intermediate transfer system and along the intermediate transfer belt 5 the image forming apparatus 100 has four image forming units P (Pa, Pb, Pc and Pd) which form a color toner image.

A toner image of yellow is formed in the image forming unit Pa, the toner image of magenta is formed in the image forming unit Pb, the toner image of cyan is formed in the image forming unit Pc and a toner image of black is formed in the image forming unit Pd.

As shown in FIG. 1, the photosensitive drums 1 (1*a*, 1*b*, 1*c*, 1*d*) as image bearing members on which toner images are borne and the process means for them are disposed in the image forming units P (Pa, Pb, Pc and Pd). Because the internal configurations of the image forming units P are the same, the subscripts a, b, c and d are omitted except when necessary in the following explanation.

In the image forming units P, after the toner images of four colors are formed on the photosensitive drums 1, the toner images are primarily transferred on the intermediate transfer belt 5 (intermediate transfer member) such that the toner images sequentially overlap with each other.

The toner images of four colors primary transferred to the intermediate transfer belt 5 are conveyed to the secondary transfer portion and are secondarily transferred to the recording material S. Thereafter, the recording material S on which the toner images are secondarily transferred in four colors is subjected to heat and pressure by the fixing device 8. Thereby, the toner images are fixed to the surface of the recording material S. Then, the recording material S is discharged to the stack tray 9.

The image forming unit P has the process means such as the corona charger 2, the exposure device 3, the developing device 4, the primary transfer roller 6 and the cleaning device 7 along the periphery of the photosensitive drum 1.

The photosensitive drum 1 has an aluminum cylinder. On the outer peripheral surface of the aluminum cylinder, a photosensitive layer having negative charge polarity is formed and the photosensitive drum 1 rotates in the direction of the arrow "a" at a process speed of 273 mm/sec. The corona charger 2 irradiates the photosensitive drum 1 with charged particles accompanied with corona discharge so that the surface of the photosensitive drum 1 is charged to a uniform negative potential. The exposure device 3 scans, with a rotating mirror, the laser beam which is ON-OFF modulated in accordance with scanning line image data in which a color separation image is expanded. Then, the exposure device 3 writes an electrostatic latent image of the image on the surface of the charged photosensitive drum 1.

The developing device 4 stirs the two-component developer mainly composed of magnetic carrier (magnetic particles) and non-magnetic toner so that the magnetic carrier is charged to positive polarity and the non-magnetic toner is charged to negative polarity. The charged two-component developer is borne on the developing sleeve (described below) that rotates around a fixed magnetic pole and rubs the photosensitive drum 1. By applying the voltage obtained by superimposing an AC voltage on the negative DC voltage to the developing sleeve, the toner charged to negative polarity is transferred to an electrostatic latent image which becomes relatively positive to the developing sleeve on the photosensitive drum 1 I transferred to the image, thereby the electrostatic latent image is developed.

The primary transfer roller 6 forms a primary transfer portion between the photosensitive drum 1 and the intermediate transfer belt 5 by pressing the intermediate transfer belt 5. By applying a DC voltage of positive polarity to the primary transfer roller 6, the negative polarity toner image borne on the photosensitive drum 1 is primarily transferred to the intermediate transfer belt 5 which passes through the primary transfer portion.

The cleaning blade of the cleaning device 7 disposed in the image forming unit P rubs the photosensitive drum 1 so that the transfer residual toner remaining on the photosensitive drum 1 which has not been primarily transferred to the intermediate transfer belt 5 is collected. The transfer belt cleaning device 10 disposed opposite the intermediate transfer belt 5 collects the transfer residual toner remaining on the intermediate transfer belt 5 which has not been secondarily transferred to the recording material S.

Figure 2:
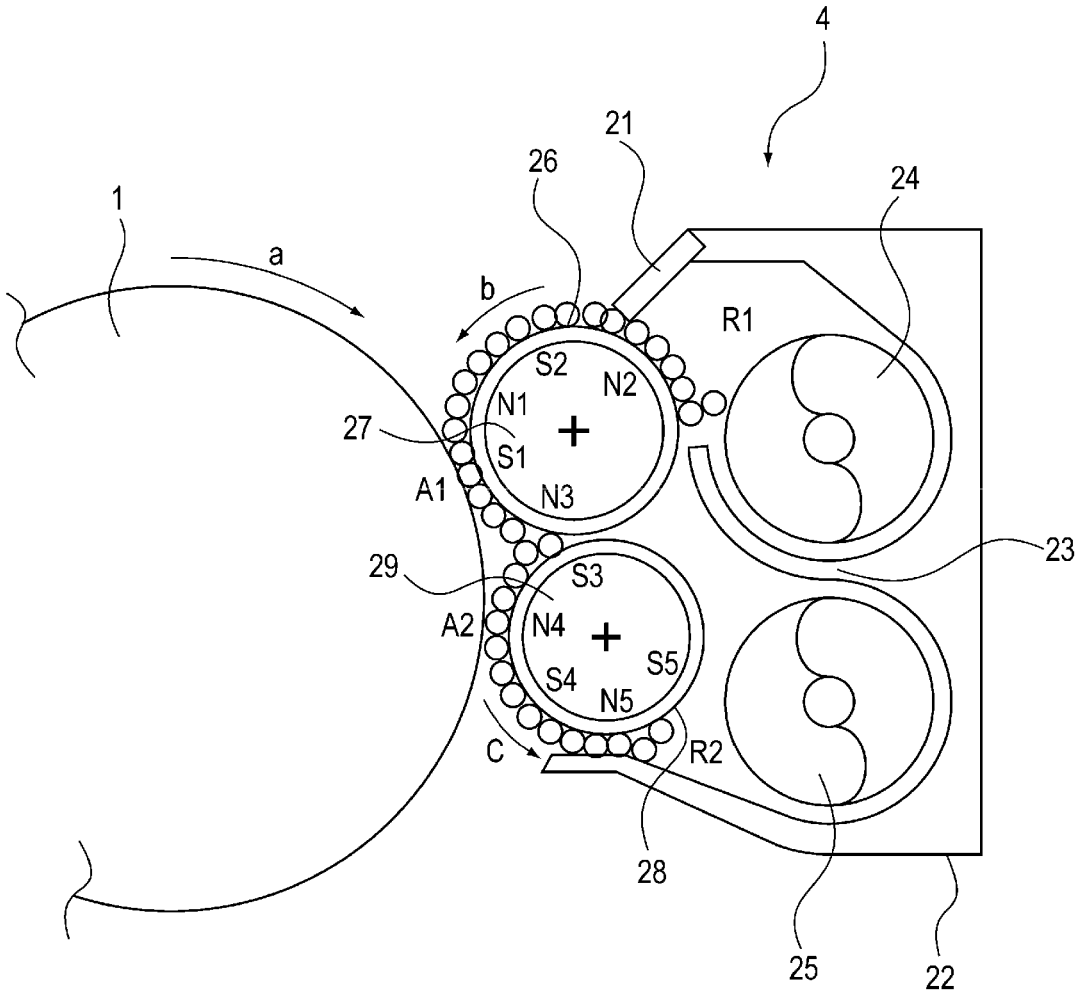
FIG. 2 is an explanatory view of a developing device of a multi-stage magnetic brush development system of an embodiment of the present invention.

(Developing device) A detailed description of the developing device 4 of the present embodiment will be made. FIG. 2 is an explanatory view of the developing device of the multi-stage magnetic brush development system of the present embodiment.

The developing device 4 comprises the developer container 22. The developing container 22 is partitioned into the stirring chamber R2 and the developing chamber R1 by the partition 23. The developer in which toner and magnetic carrier are mixed is stored in the developing chamber R1 and the stirring chamber R2. As the magnetic carrier used in the present invention, a ferrite carrier or a resin magnetic carrier consisting of a binder resin, a magnetic metal oxide and a non-magnetic metal oxide or the like can be used.

The first conveying screw 24 is disposed in the developing chamber R1 stirs and conveys the developer. By the rotation of the first conveyance screw 24, the developer is conveyed along the longitudinal direction of the upstream developing sleeve 26. The second conveying screw 25 is disposed in the stirring chamber R2 and stirs and conveys the developer in the longitudinal direction of the downstream developing sleeve 28. The direction of conveyance of the second conveying screw 25 is the opposite direction of the first conveying screw 24.

Openings are provided on the near side and the far side on the partition 23. The developer conveyed by the first conveying screw 24 is passed to the second conveying screw 25 via one of the openings. Moreover, the developer conveyed by the second conveying screw 25 is passed to the first conveying screw 24 via the other opening. Thus, the developer is circulated and conveyed while being passed at both ends of the developing chamber R1 and the stirring chamber R2.

An opening portion is provided at a place on the developing container 22 adjacent to the photosensitive drum 1. As a developer bearing member, the upstream developing sleeve 26 (first developer bearing member) and the downstream developing sleeve (second developer bearing member) are provided in the developer container 22. In addition, each of the upstream developing sleeve 26 and the downstream developing sleeve 28 has the thickness of 1 mm, the outer diameter of 25 mm, the length in the thrust direction is 350 mm.

The first magnet roller 27 (first magnetic field generating member) having a roller shape is fixedly disposed in the upstream developing sleeve 26. The upstream developing sleeve 26 rotates in the direction of arrow "b" (direction opposite to the rotating direction of the photosensitive member) and bears and conveys the developer.

The layer thickness regulating blade 21 is disposed so as to face the upper portion of the upstream developing sleeve 26 in the upstream of the portion facing the photosensitive drum 1 of the upstream developing sleeve 26. By the layer thickness regulating blade 21, the layer thickness of the developer supplied to the upstream developing sleeve 26 from the first conveying screw 24 in the developing chamber R1 is restricted.

As shown in FIG. 2, the magnetic pole N2 is provided inside of the first magnet roller 27 in the vicinity of the layer thickness regulating blade 21. The accumulated developer bound to the magnetic force of the magnetic pole N2 is regulated to an appropriate developer layer thickness by the layer thickness regulating blade 21. Then, the developer of which layer thickness is regulated is conveyed to and borne on the portion (first developing region A1) where the upstream developing sleeve 26 is opposed to the photosensitive drum 1.

The first magnetic roller 27 includes the magnetic pole S1 (developing pole) facing the first developing region A1. With the developing magnetic field formed at the first developing region A1 by the magnetic pole S1, the magnetic brush of the developer is formed on the first magnet roller 27. The magnetic brush contacts the photosensitive drum 1 which rotates in the direction of the arrow "a" at the first developing region A1. Thus, the electrostatic latent image is developed at the first developing region A1 and becomes a toner image. This is the first development by the developing device 4.

At this time, the toner adhering to the magnetic brush and the toner adhering to the developing sleeve surface are transferred to the image area of the electrostatic latent image and develop it. In this embodiment, the first magnet roller 27 has the magnetic poles N1, N3 and S2 in addition to the above-mentioned magnetic poles S1 and N2. The magnetic poles N1 and N3 are adjacent to each other and have the same polarity. A low magnetic field region is formed between them. With this construction, a barrier is formed against the developer.

Below the upstream developing sleeve 26, at the region facing to both of the upstream developing sleeve 26 and the photosensitive drum 1, the downstream developing sleeve 28 is disposed. The downstream developing sleeve 28 is disposed as to be able to rotate in the direction (the same direction of the upstream developing sleeve 26) of the arrow "c". The downstream developing sleeve 28 is made of non-magnetic material similarly as the upstream developing sleeve 26.

Inside the downstream developing sleeve 28, the second magnet roller 29 (second magnetic field generating member) is disposed in a non-rotating state. The second magnet roller 29 has five poles of the magnetic pole S3 (delivery pole), the magnetic pole N4, the magnetic pole S4, the magnetic pole N5 and the magnetic pole S5 (stripping pole).

The magnetic brush on the magnetic pole N4 is in contact with the photosensitive drum 1 at the portion (second developing region A2) where the downstream developing sleeve 28 is opposed to the photosensitive drum 1. Thus, the second development of the surface of the photosensitive drum 1 is performed at the second developing region A2 after the surface has passed through the first development region A1. The developer used for the second development at the downstream developing sleeve 28 is returned to the stirring chamber R2.

Among the plurality of magnetic poles included in the second magnetic roller 29, the magnetic pole S3 and the magnetic pole S5 have the same polarity. Thus, a low magnetic field region is formed between the magnetic pole S3 and the magnetic pole S4 and a barrier is formed against the developer. Further, among the magnetic poles of the second magnet roller 29, the magnetic poles S3 is opposed to the magnetic pole N3 of the first magnet roller 27 which is included in the upstream developing sleeve 26 in the vicinity of the position where the two sleeves are closest.

Figure 3:
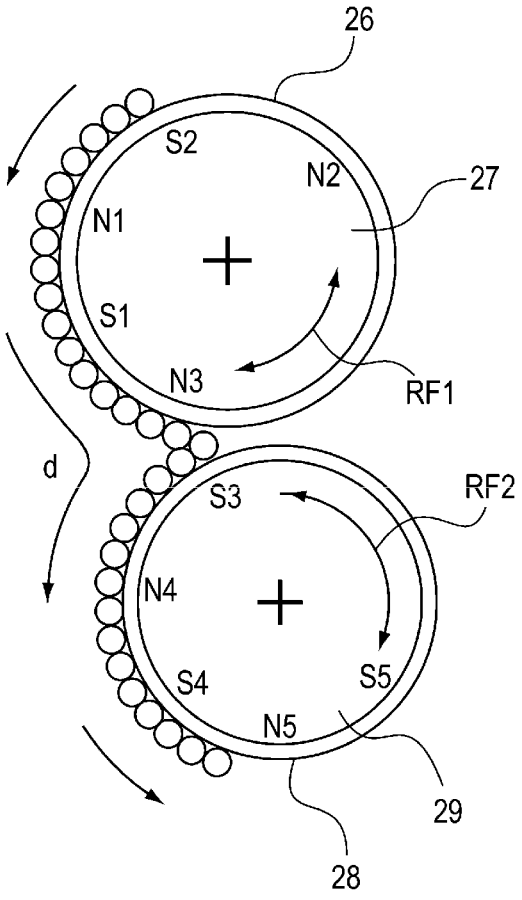
FIG. 3 is an enlarged view of the periphery of the developer bearing member of the multi-stage magnetic brush development system of an embodiment of the present invention.

(Flow of the developer) A flow of the developer by the above-described configuration will be explained. FIG. 3 is an enlarged view near the developer bearing member of the multi-stage magnetic brush development system of the present embodiment.

As shown in FIG. 3, the first low magnetic field region RF1 is formed between the magnetic pole N3 and the magnetic pole N2 of the first magnet roller 27 in the upstream developing sleeve 26. In addition, the second low magnetic field region RF2 is formed between the magnetic pole S3 and the magnetic pole S5 of the second magnet roller 29 of the downstream developing sleeve 28.

Thus, when the developer which is conveyed on the upstream developing sleeve 26*j* and which passes through the first developing region A1 (see FIG. 2) reaches the magnetic pole N3, the developer cannot pass through the closest position of the sleeves due to the first low magnetic field region RF1 and the second low magnetic field region RF2. The developer is moved to the side of the downstream developing sleeve 28 in accordance with the magnetic force lines extending from the magnetic pole N3 to the magnetic pole S3 as shown by an arrow "d". Then, the developer is conveyed through the surface of the downstream developing sleeve 28 to the second conveying screw 25 of the stirring chamber.

In this embodiment, the downstream developing sleeve 28 is provided under the upstream developing sleeve 26. Thus, the developer is conveyed on the upstream developing sleeve 26 in the order of the magnetic pole N2, the magnetic pole S2, the magnetic pole N1, the magnetic pole S1 and the magnetic pole N3. Then, the developer on the upstream developing sleeve 26 is blocked by the low magnetic field regions of both sleeves described above and is delivered to the downstream developing sleeve 28. Then, the developer is conveyed on the downstream development sleeve 28 in the order of the magnetic pole S3, the magnetic pole N4, the magnetic pole S4, the magnetic pole N5 and the magnetic pole S5. Then, the developer is stripped from the downstream developing sleeve 28 at the magnetic pole S5 by the second low magnetic field region RF2 and the developer falls to the stirring chamber R2.

In addition, it is not necessary for the magnetic pole N3 and the magnetic pole S3 which are delivery poles to be completely opposed to each other. When they are substantially opposed in a range of the displacement of 45° from the state of completely opposing to each other, it is possible to smoothly deliver the developer.

(Ingress prevention configuration to developer delivery portion) The configuration for preventing ingress of the developer after development into the region between the upstream developing sleeve 26 and the downstream developing sleeve 28 will be explained.

The developer stripped at the magnetic pole S5 to the stirring chamber R2 is liable to move to the area between the upstream developing sleeve 26 and the downstream developing sleeve 28 with the force caused by the rotation of the downstream developing sleeve 28. This is due to the effect of the magnetic force of the magnetic pole N3 and the magnetic pole S3 of the developer delivery portion between the upstream developing sleeve 26 and the downstream developing sleeve 28.

When the developer moves to the area near the developer delivery portion, the developer is about to enter between the upstream developing sleeve 26 and the downstream developing sleeve 28. As a result, the developer coating amount on the downstream developing sleeve 28 is increased and various defective images are concerned.

When the regulating member is displaced in the region between the upstream developing sleeve 26 and the downstream developing sleeve 28 as in the prior art, it is possible to block the entering of the developer into this area. However, as described above, the problem occurs that the developer remains in the vicinity of the regulating member.

Thus, in the present embodiment the problem is solved by devising the magnet roller. This will be explained below.

The main cause of the developer entering the region between the two developing sleeves is that the developer conveyed on the downstream developing sleeve 28 is not peeled sufficiently between repulsion poles. One reason why the developer is not peeled between repulsion poles is that the magnetic force acting on the magnetic carrier remains between repulsion poles. By the remaining magnetic force between repulsion poles, it is hard for the magnetic carrier to be peeled off from the developing sleeve. In addition, the carrier which is once peeled is easy to adhere to the developing sleeve again.

The magnetic force applied to the magnetic carrier can be expressed as in FIG. 4. FIG. 4 is a diagram summarizing the formulas for describing a magnetic force on the magnetic carrier. In the formulas in FIG. 4, the magnetic force F is denoted as an external magnetic field (magnetic flux density B) and the magnetic force F is expressed in the cylindrical coordinates with the z-direction being the axial direction of the downstream developing sleeve 28.

In view of the formula of FIG. 4, when there is a change in the strength of the magnetic field B ($=\{Br^2+B\theta^2+Bz^2\}^{1/2}$, it can be seen that the magnetic force is generated from a point where the flux density is low to the direction where the magnetic flux density is high. Conversely, the magnetic force does not work for the direction along which there is no change in the magnetic field strength |B|.

In this embodiment, the configuration is employed where there is nearly no change in the magnetic field strength |B| in the z-direction except for the end portions as in the prior art in order that the coating conditions of the developer do not change at the thrust position. Thus, Fz is substantially zero.

The magnetic field strength |B| in the r-direction rapidly decreases as the distance (in r-direction) from the magnetic roller becomes larger. Thereafter, the magnetic field strength |B| monotonically decreases to zero at infinity. Thus, Fr which is an r component of the magnetic force is large in the vicinity of the developing sleeve and Fr monotonically decreases to zero at infinity as the distance from the developing sleeve becomes larger. When the magnetic field strength |B| in θ direction has a minimal point or a maximal point, Fθ which is θ component of the magnetic force at that position becomes zero. Although Fθ is certainly low at the position of the maximal point but Fr becomes high. This is because the magnetic force is affected not only by a change in the magnetic field strength |B| but also by an absolute value of the magnetic field strength |B| and the magnetic force becomes larger as the magnetic field strength |B| becomes larger as it can be seen from FIG. 4.

On the other hand, because Fr as well as Fθ becomes small at the minimal point, the total magnetic force $|F|=(Fr^2+F\theta^2+Fz^2)^{1/2}$ applied to the carrier can be reduced.

Figure 5:
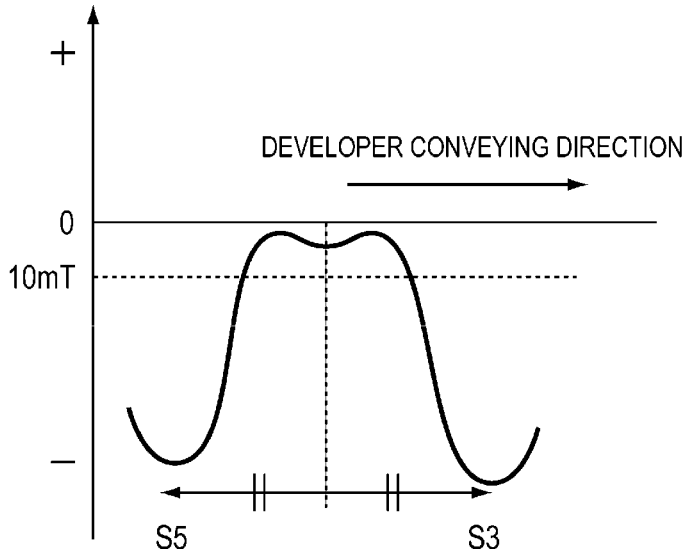
FIG. 5 is a graph showing a normal component of a magnetic flux density of the vicinity of the low magnetic field region of the second magnetic field generation member of an embodiment of the present invention.

FIG. 5 is a graph showing the normal component of the magnetic flux density in the vicinity of the repulsion poles of the second magnetic field generating member of the present embodiment. In FIG. 5, the magnetic flux density is measured while changing the angle of the surface position of the downstream developing sleeve 28. Specifically, shown in FIG. 5 is the magnetic flux density in the vicinity of the repulsion poles (the magnetic pole S5 and the magnetic pole S3) of the second magnet roller 29 in the downstream developing sleeve 28. In FIG. 5, "+" of the vertical axis denotes N-pole and "−" denotes S-pole.

In view of the above relationship, the second magnetic roller 29 of this embodiment is characterized in that it has two minimal points in the normal component of the magnetic flux density between the repulsion poles and in that the two minimal points are separately placed both at the upstream side and at the downstream side of the central position between repulsion poles.

With this configuration, it is possible to prevent ingress of the developer into the region between the two developing sleeves (the upstream developing sleeve 26 and the downstream developing sleeve 28). Specific action will be explained below.

The magnetic force applied to the magnetic carrier is reduced at the minimal point in the magnetic flux density. Thus, the magnetic carrier conveyed on the developing sleeve is peeled off at the first minimal point located at the side of the magnetic pole S5. In addition, the magnetic carrier which has been peeled off is hardly attracted to the sleeve side again because of the second minimal point by the magnetic pole S3.

Thus, as the second minimal point is close to the magnetic pole S3, and as the first minimal point is away from the second minimal point, the magnetic carrier peeled off at the first minimal point becomes harder to adhere to the developing sleeve again. Thus, it is preferable that the two minimal points are separately placed both at the upstream side and at the downstream side of the central position between repulsion poles.

With the above structure, the two minimal points in magnetic flux density play roles of supporting the stripping of developer and of preventing re-deposition of the developer between the repulsion poles. Thus, it is possible to enhance the above functions (support of stripping and prevention of re-deposition) as compared for example with the configuration in which a single broad minimal curve is provided between the repulsion poles.

When the configuration is employed where one broad minimal curve is provided between the repulsion poles, there is the concern that the minimal point between repulsion poles tends to be a different pole. When the minimal point between the repulsion poles becomes a different pole, magnetic field lines extend between the repulsion poles and the minimal point with reverse polarity and magnetic force is generated, thereby repulsion poles become non-functional.

In contrast, in the present embodiment, two minimal points are provided between the repulsion poles thereby the two minimal points can be weak in the same polarity as that of the repulsion poles. For this reason, the different polarity is hard to occur.

As explained above, when the configuration is employed in which a plurality of minimal points are provided, the occurrence of the different polarity which is a concern for the configuration in which a single broad minimal curve is provided can be suppressed and the region of low magnetic field can be widened.

In addition, it is not necessary to have just two minimal points. The configuration can be employed in which more than two minimal points are provided. When the minimal points of the most downstream side and the most upstream side between the repulsion poles are set to two minimal points described above, the same effect can be obtained.

Then, the definition (measuring method) of a minimal point will be explained. The magnetic flux density Br is measured by the measuring instrument "MS-9902" (trade name) F. W. BELL Co. such that the distance between the probe which is a part of the measuring instrument and the surface of the developing sleeve is set to approximately 100 μm.

The measurement pitch of the circumferential direction is set to about 1° and the data measured at 360 points in the circumferential direction are used. When using a pitch less 1°, a fluctuation of a measurement value can erroneously be determined as a minimal point. Thus, a minimal point in the present invention refers to a minimal point that can be recognized by measurement of 1° (±0.1°) pitch as mentioned above.

Figure 6:
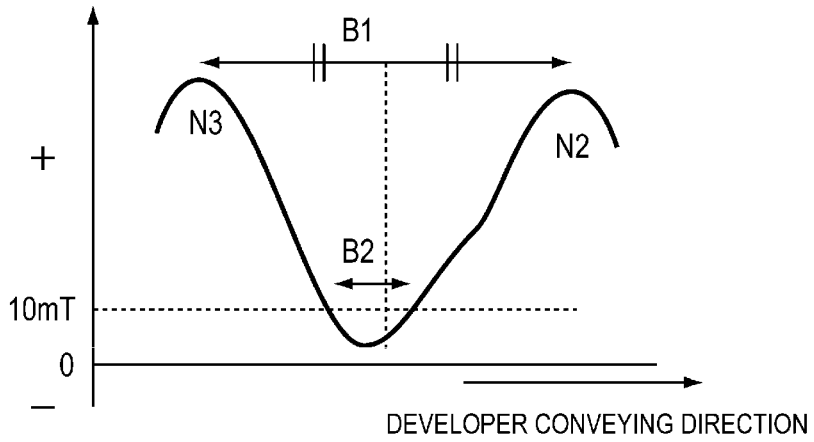
FIG. 6 is a graph showing a normal component of a magnetic flux density of the vicinity of the low magnetic field region of the first magnetic field generating member of an embodiment of the present invention.

Next, the upstream developing sleeve 26 will be explained. FIG. 6 is a graph showing a normal component of the magnetic flux density in the vicinity of the repulsion poles of the first magnetic field generating member of this embodiment. In FIG. 6, the magnetic flux density is measured while changing the angle of the surface position of the upstream developing sleeve 26. In FIG. 6, "+" in the vertical axis denotes the N-pole and "−" denotes the S-pole as in FIG. 5.

The first magnet roller 27 in the present embodiment is characterized in that unlike the second magnet roller 29, only one minimal point in the magnetic flux density is provided between the repulsion poles and the minimal point is placed at the upstream side of the central position between repulsion poles. The reason for adopting such an arrangement will be explained.

Unlike the downstream developing sleeve 28, the layer thickness regulating blade 21 is disposed at a position facing the upstream developing sleeve 26. Thus, the magnetic pole N2 in the upstream developing sleeve 26 is a pole constituting a repulsion pole at the downstream side in the rotation direction of the developing sleeve similarly to the pole S3 in the downstream developing sleeve 28.

However, the magnetic pole N2 in the upstream developing sleeve 26 is different from the pole S3 in the downstream developing sleeve 28 in that the magnetic pole N2 also plays a role of pumping the developer. When two minimal points in the same magnetic flux density are provided similar to the second magnet roller 29, there is a concern that the pumping property of the developer can be affected.

In view of the above, the first magnet roller 27 is configured to have only one minimal point between the repulsion poles.

Furthermore, in this embodiment, one minimal point of the first magnet roller 27 is disposed at an upstream side from the center position between the repulsion poles in the rotation direction of the upstream developing sleeve 26. As a result, the pumping property of the magnetic pole N2 is further enhanced and it is possible to more effectively suppress the dragging of the developer in the direction from the magnetic pole N3 to the magnetic pole N1.

Unlike the second magnet roller 29, it is desirable for the first magnet roller 27 to have relatively large magnetic flux density in the region located at downstream side in the rotating direction of the sleeve between the repulsion poles in order to ensure the property of the pumping of the developer. Thus, the area B2 in which the magnetic flux density distribution Br≤10 mT is preferably configured so as to be less than half of the area B1 between the magnetic pole N2 and the magnetic pole N3 constituting repulsion poles. Although there is a concern that the configuration with a single broad minimal curve tends to have an opposite polarity as mentioned above, with the above structure, the occurrence of opposite polarity can be suppressed.

Next a specific configuration of this embodiment will be described by way of examples.

Example 1

Figure 7:
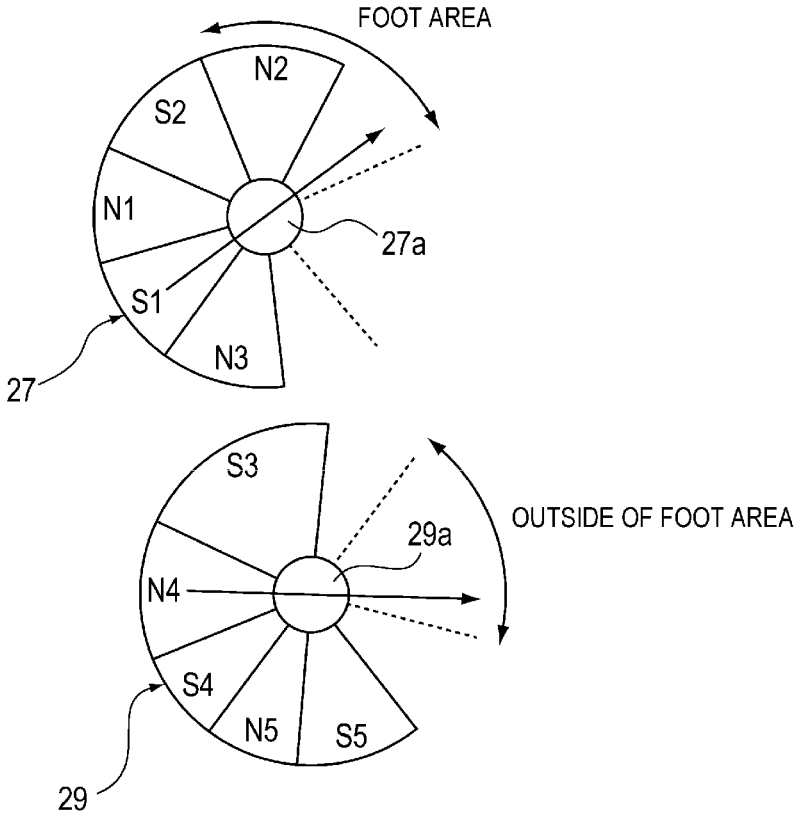
FIG. 7 is a diagram for explaining the structure of example 1 according to an embodiment of the present invention.

The structures of the first magnet roller 27 which is included in the upstream developing sleeve 26 and the second magnet roller 29 which is included in the downstream developing sleeve 28 will be explained in detail. FIG. 7 is a diagram illustrating the configuration of the Example 1 according to the present embodiment.

At the centers of the first magnet roller 27 and the second magnet roller 29, the shaft 27*a* and the shaft 29*a* of the round shaft are provided as a rotation axis. In this example, the magnet rollers have five magnetic poles. Thus, in order to form five poles of the magnetic pole N2 (scooping pole), the magnetic pole S2, the magnetic pole N1, the magnetic pole S1 and the magnetic pole N3 (delivery pole) around the shaft, five magnet pieces are bonded at positions corresponding to magnetic poles respectively. Although five magnetic poles and five the magnet pieces are used in this example, the invention is not limited to this.

In this example, the shafts 27*a*, 29*a* are made of stainless steel. However, the invention is not limited to this and any material with a certain rigidity such as metals including iron can be used. The shafts in this example have a round shape but they may be other shapes.

The magnet pieces may be configured with a known magnet such as a resin magnet in which resin or rubber is based or sintered magnet. In this example, resin magnet pieces are formed into a stretched fan shape and these are bonded radially to the shaft with adhesive to constitute the magnet roller.

The configuration of the second magnet roller 29 in this example will be described in detail with the reason for employing this configuration.

Typically, a distribution of the magnetic flux density between the repulsive poles tends to be a distribution in which maximal points are provided at repulsion poles and one minimal point is provided between the repulsion poles. To be more precise, when the total of half value widths (2 times half value half width=half value full width) of the two poles constituting repulsion poles is greater than the angle between the maximal points at repulsion poles, such distribution tends to have one minimal point between the repulsion poles.

This is due to the following reason. The magnetic flux density of repulsion poles converges to approximately zero at an angle of about two times the half value half width (=half value width) from the position of the maximal point of each repulsion pole between repulsion poles. In this case, when the total of the half value width of the two poles constituting the repulsion poles is greater than the angle between the maximal points of repulsion poles, the foot parts of the magnetic flux densities having maximal points at two repulsion poles overlap between repulsion poles. Then, the magnetic flux density which has been gradually attenuated from the maximal point at one repulsion pole begins to overlap with the foot part of a maximal curve at the other repulsion pole in the vicinity of zero. Thus, the magnetic flux density starts to increase.

Thus, when the total of half value widths of the two poles constituting repulsion poles is greater than the angle between the maximal points at repulsion poles, such distribution tends to have one minimal point between the repulsion poles because the magnetic flux density shifts from decreasing to increasing between repulsion poles.

On the other hand, when the total of half value widths of the two poles constituting repulsion poles is smaller than the angle between the maximal points at repulsion poles, the foot parts of the magnetic flux densities having maximal points at two repulsion poles do not overlap between repulsion poles. Therefore, it is possible to have more than one minimal point. Specifically, it is possible to have two minimal points by generating a weak maximal point which has the same polarity as that of repulsion poles in the region in which the foot parts of the magnetic flux densities do not overlap.

Thus, in the present example, a weak maximal point which has the same polarity as that of repulsion poles is generated in the region in which the foot parts of the magnetic flux densities do not overlap in the following manner.

Generally, if the magnetic pole which has the largest magnetic flux density among the magnetic poles constituting the magnet roller is placed at the back side across the axis of the repulsion poles (180° opposite side), the balance of the magnetic field is changed such that the energy is minimized. As a result, the pole with the largest magnetic flux density and the opposite polarity tends to weakly occur between the magnetic poles at the back side of the magnetic pole.

Thus, in the present example, as shown in FIG. 7, in the second magnetic roller 29, the angle between the magnetic pole S3 and the magnetic pole S5 constituting repulsion poles is configured to be larger than the total angle of half value widths of the magnetic poles S3 and S5.

In addition, a weak maximal point having the same polarity of the repulsion poles is generated in the region (outside the foot part) in which the foot parts of the magnetic flux densities do not overlap, which corresponds to outside the angle of the half value width (two times the half value half width) from the extreme points of the magnetic poles S3 and S5. Thus, the magnetic pole N4 which has the largest magnetic flux density among the magnetic poles with the opposite polarity of the repulsion poles which constitute the magnet roller is disposed at the 180° back side of the region (outside the foot part) in which the foot parts of the magnetic flux densities do not overlap.

As a result, even if there originally exists one minimal point between repulsion poles, the S-pole weakly generated by the presence of the magnet pole N4 with large magnetic force provided at the back of the repulsion poles overlaps with the above mentioned minimal curve and two minimal points can be obtained.

Even if the magnetic pole N4 is provided at the 180° back side of the region (region of less then half value width from the extreme points at repulsion poles), the S-pole weakly generated by the presence of the magnetic pole N4 may overlap with the distribution of the magnetic flux density of the repulsion poles. In this case, two minimal points cannot be obtained. Thus, to surely obtain two minimal points, it is preferable to locate the magnetic poles N4 at the 180° back side of the region in which foot parts of the magnetic flux density do not overlap.

The magnetic pole N4 is configured to have the largest magnetic flux density among the magnetic poles constituting the second magnet roller 29 thereby the generation of the opposite pole is prompted. In order to make minimal curve clear, it is preferable to set the magnetic flux density more than 80 mT.

The first magnet roller 27 in this example has the following configuration.

The first magnet roller 27 in the present embodiment is characterized in that only one minimal point in the magnetic flux density is provided between the repulsion poles and the minimal point is placed at the upstream side of the central position between repulsion poles in the rotating direction of the developing sleeve.

The first magnet roller 27 of the present example has the magnetic pole S1 at the back side of repulsion poles. The magnetic pole S1 has the opposite polarity of the magnetic pole N2 and the magnetic pole N3 which are repulsion poles and which have more than 80 mT of the magnetic flux density. The position at which the magnetic pole S1 is located is different from that in the magnet roller 29.

That is, the magnetic pole S1 with the largest magnetic flux density among the magnetic poles in the first magnet roller 27 is disposed at the 180° back side of the region in which the angle is smaller than the half value width (two times the half value half width) from the maximal point at the magnetic pole N2.

Thus, the N-pole is weakly generated in the vicinity of the magnetic pole N2 located at the downstream side in the rotating direction of the upstream developing sleeve 26 by the presence of the magnetic pole S1 with large magnetic force. As a result, the minimal point which originally exists between the repulsion poles can be shifted to the magnetic pole N3 side located at upstream side in the rotational direction of the upstream developing sleeve 26.

The magnetic pole S1 is configured to have the largest magnetic flux density among the magnetic poles constituting the first magnetic roller 27 thereby the generation of an opposite pole is promoted. It is preferable for the magnetic pole S1 to have more than 80 mT of the magnetic flux density in order to make clearer the shift of the minimal point.

The half value width of repulsion poles in this example can be adjusted by changing the shape of the magnet pieces working as magnetic poles. The present example uses fan-shaped magnet pieces as shown in FIG. 7. Thus, by changing the angle of the fan shape, the half value width can be adjusted. When the angle of the fan shape becomes larger, the half value width becomes larger and when the angle of the fan shape becomes smaller, the half value width becomes smaller.

Example 2

Figure 8:
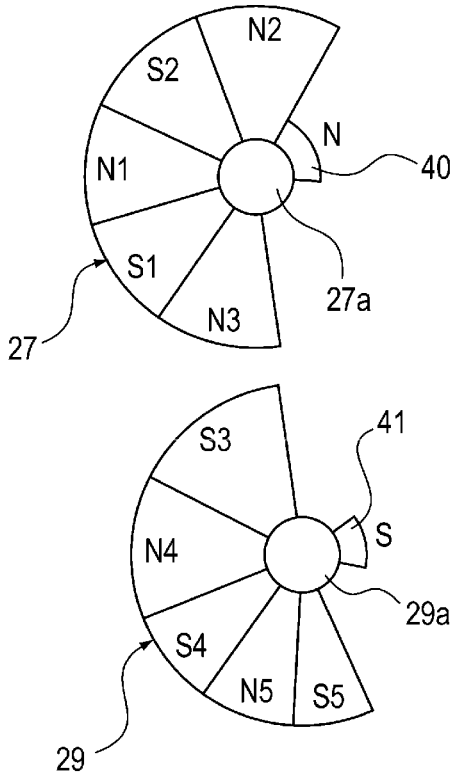
FIG. 8 is a diagram for explaining the structure of example 2 according to an embodiment of the present invention.

The example 2 will be described with reference to FIG. 8. FIG. 8 is a diagram illustrating the configuration of the example 2 according to the present embodiment.

In Example 1, a magnetic pattern having the effect of the present embodiment is created by utilizing the fact that magnetic force of the same polarity as the repulsion poles is generated between the repulsion poles by placing a magnetic pole with opposite polarity of repulsion poles which have high magnetic force at the back side of the area between the repulsion poles.

With the configuration of the Example 1, the effect can be obtained with a simple structure. However, the arrangement of the magnetic poles must be determined by the various factors including the positional relationship between the photosensitive drum 1 and the developing container 22 and effect on image quality. Thus, the arrangement of the Example 1 cannot always be realized.

As a countermeasure for this case, in this example, the magnet 40 and the magnet 41 having magnetic poles with the same polarity as repulsive poles are directly disposed between the repulsion poles in addition to five magnetic pieces.

Specifically, the magnet 41 of S-pole is disposed on the region (the region in which the angle is not within half value width (two times half value half width) from the extreme point of each of repulsion poles) where foot parts of the magnetic flux densities between repulsion poles do not overlap of the shaft 29*a* of the second magnet roller 29. The magnet 40 of N-pole is disposed on the shaft 27*a* in the region (the region in which the angle is within half value width (two times half value half width) from the extreme value point of the repulsion pole) corresponding to a foot part of the magnetic flux density of the pole of the downstream side of repulsion poles. With these configurations, the similar effect of the Example 1 can be obtained.

Example 3

Figure 9:
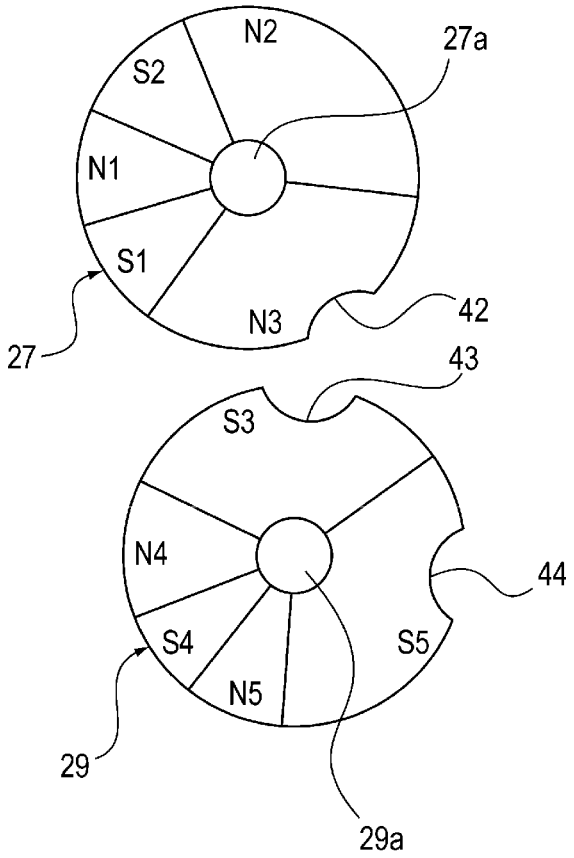
FIG. 9 is a diagram for explaining the structure of example 3 according to an embodiment of the present invention.
Figure 10:
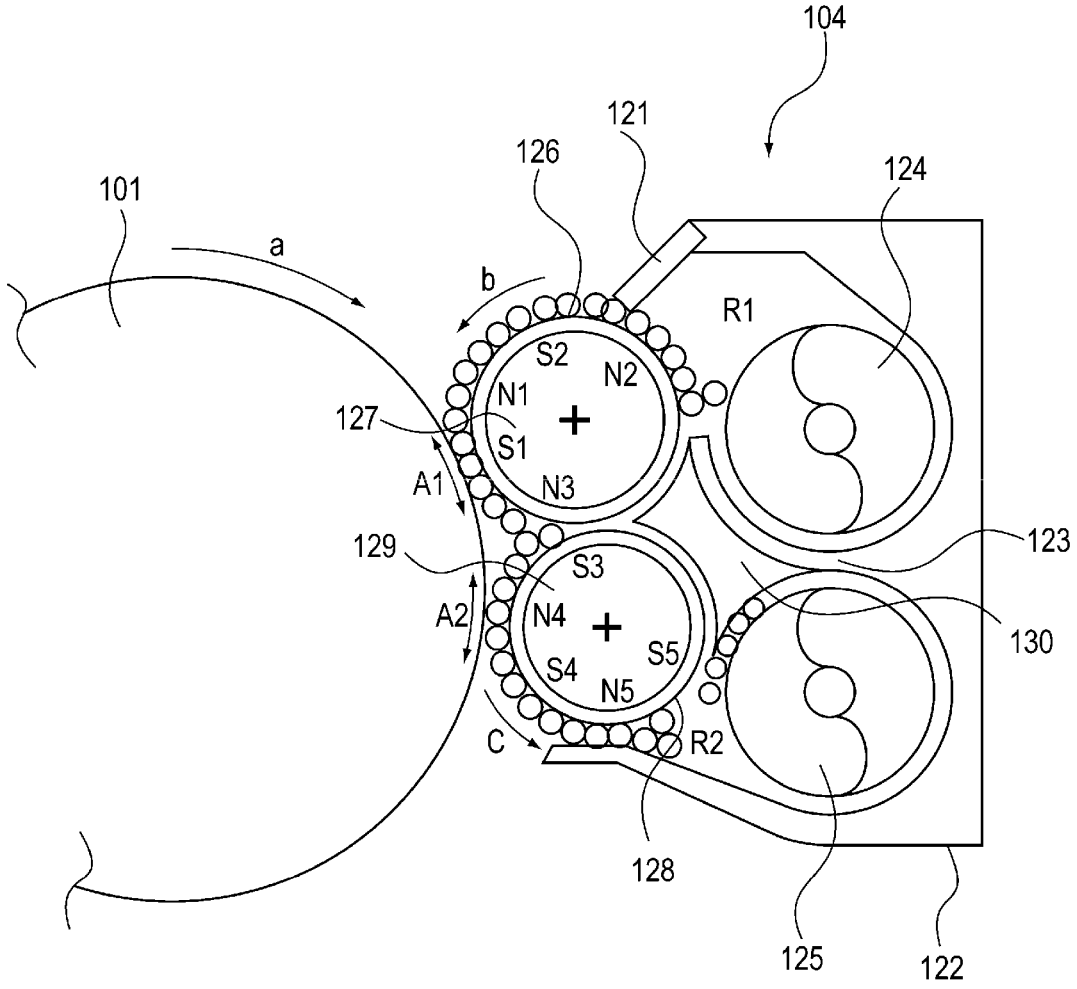
FIG. 10 is an explanatory diagram of a conventional developing device of a multi-stage magnetic brush development system.

The example 3 will be described with reference to FIG. 9. FIG. 9 is a diagram illustrating the configuration of the example 3 of the present embodiment.

As in Example 2, when a magnet piece is not affixed to the area on the shaft between repulsion poles, it is possible to affix the magnetic poles having the opposite polarity. However, there is the case where the area on the shaft between repulsion poles is covered with magnetic pieces.

In this case, a part of the magnet piece at a position corresponding to the minimal point is cut off. Specifically, as shown in FIG. 9, the first magnetic roller 27 is provided with the notch 42 in a part of the magnetic pole N3. The second magnetic roller 29 is provided with the notch 43 in a part of the magnetic pole S3 and the notch 44 in a part of the magnetic pole S5. This makes it possible to form a similar magnetic pattern as that of the Example 1 and the same effect as in Example 1 is obtained.

In the present embodiment, as long as the structure is employed which has at least two or more minimal points of the normal component of the magnetic flux density between the repulsion poles of the magnet roller in the downstream developing sleeve 28, a part of or all of the configuration of this embodiment may be another structure that is replaced by an alternative configuration.

Therefore, the present invention can be applied to various types of the image forming apparatus such as tandem type, 1-drum type, intermediate transfer type, direct rotor type, two-component developer type and magnetic one-component developer type. In the present embodiment, although only the main part of the formation of the toner image is described, the present invention is applied to various printing machines, copiers, facsimile machine, MFP and so on by adding necessary devices, equipment and a housing structure.

Other Embodiments

In the embodiment described above, two or more minimal points are formed only in the second low magnetic field region RF2 of the second magnet roller 29. However, the present invention is not limited to this structure. For example, in addition to the second low magnetic field region RF2, the configuration may be employed that two or more minimal points are formed in the first low magnetic field region RF1 of the first magnet roller 27.

By using the above structure, an occurrence of agglomeration is suppressed and a high image quality can be maintained.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-059931, filed Mar. 24, 2014 which is hereby incorporated by reference herein in its entirety.

What is claimed is:

1. A developing device, comprising:

a first developer bearing member configured to bear developer including non-magnetic toner and magnetic carrier and to develop an electrostatic latent image at a first developing region;

a second developer bearing member disposed oppositely to the first developer bearing member, which is configured to bear the developer delivered from the first developer bearing member and to develop the electrostatic latent image at a second developing region;

a first magnet fixed inside the first developer bearing member, which is configured to make the first developer bearing member bear the developer on the surface of the first developer bearing member, the first magnet including a pair of first repulsion magnetic poles with the same polarity as each other, the first repulsion magnetic poles being disposed adjacent to each other;

a second magnet fixed inside the second developer bearing member, which is configured to make the second developer bearing member bear the developer on the surface of the second developer bearing member, the second magnet including a pair of second repulsion magnetic poles with the same polarity as each other, the second repulsion magnetic poles being disposed adjacent to each other, wherein the first magnet is configured such that a magnetic flux density distribution of a normal component of the first developer bearing member in the circumferential direction of the first developer bearing member has only one minimal point between the pair of first repulsion magnetic poles, and wherein the second magnet is configured such that the magnetic flux density distribution of a normal component of the second developer bearing member in the circumferential direction of the second developer bearing member has a plurality of minimal points between the pair of second repulsion magnetic poles.

2. The developing device according to claim 1, wherein the minimal point formed between the pair of first repulsion magnetic poles is positioned at an upstream side of a middle point between the pair of repulsion magnetic poles in a rotational direction of the first developer bearing member, and wherein the plurality of the minimal points between the pair of the second repulsion magnetic poles include a first minimal point formed at a downstream side of a middle point between the second repulsion magnetic poles and a second minimal point formed at an upstream side of a middle point between the second repulsion poles.

3. The developing device according to claim 1, wherein the second magnet includes a developing magnetic pole which is closest to the second developing region, and wherein the position which has a phase difference of 180 degrees with respect to an extreme point of the developing magnetic pole is located between the pair of second repulsion magnetic poles and outside a half value width area of the second repulsion magnetic poles.

4. The developing device according to claim 1, wherein notches corresponding to the plurality of minimal points are formed on outer peripheral surfaces of the pair of second repulsion magnetic poles.

5. The developing device according to claim 1, wherein the magnetic pole disposed at an upstream side in a rotational direction of the first developer bearing member among the pair of first repulsion poles is opposed to the second developer bearing member and is a delivery pole which delivers the developer to the second developer bearing member, and wherein the magnetic pole disposed at a downstream side in a rotational direction of the second developer bearing member among the second repulsion magnetic poles has an opposite polarity to the delivery pole and is opposed to the delivery pole and is a receiving pole which receives the developer from the first developer bearing member.

6. An image forming apparatus, comprising:

an image bearing member; and the developing device according to claim 1 for supplying toner to the image bearing member.

* * * * *